US011724410B2

(12) United States Patent
Khubani et al.

(10) Patent No.: US 11,724,410 B2
(45) Date of Patent: Aug. 15, 2023

(54) PORTABLE HAIR REMOVAL APPARATUS

(71) Applicant: Church & Dwight Co., Inc., Ewing, NJ (US)

(72) Inventors: Anand Khubani, Morristown, NJ (US); Eric Langberg, Milford, PA (US); David Stowers, Morristown, NJ (US)

(73) Assignee: Church & Dwight Co., Inc., Ewing, NJ (US)

( * ) Notice: Subject to any disclaimer, the term of this patent is extended or adjusted under 35 U.S.C. 154(b) by 552 days.

(21) Appl. No.: 16/524,441

(22) Filed: Jul. 29, 2019

(65) Prior Publication Data

US 2020/0039096 A1 Feb. 6, 2020

Related U.S. Application Data

(60) Provisional application No. 62/712,853, filed on Jul. 31, 2018.

(51) Int. Cl.

| | |
|---|---|
| ***B26B 19/38*** | (2006.01) |
| ***B26B 19/46*** | (2006.01) |
| ***A47K 7/04*** | (2006.01) |
| *B26B 19/14* | (2006.01) |

(52) U.S. Cl.

CPC ..... *B26B 19/3853* (2013.01); *A47K 7/04* (2013.01); *B26B 19/3813* (2013.01); *B26B 19/3826* (2013.01); *B26B 19/3833* (2013.01); *B26B 19/46* (2013.01); *B26B 19/14* (2013.01); *B26B 19/3873* (2013.01); *B26B 19/3886* (2013.01)

(58) Field of Classification Search

CPC ..... B26B 19/3853; B26B 19/3813; B26B 19/3826; B26B 19/3833; B26B 19/46; B26B 19/14; B26B 19/3873; B26B 19/3886; A47K 7/04

See application file for complete search history.

(56) References Cited

U.S. PATENT DOCUMENTS

| | | | |
|---|---|---|---|
| D190,785 | S | 6/1961 | Kruck |
| D191,448 | S | 10/1961 | Veersema |
| 3,116,551 | A | 1/1964 | Anton |
| 3,392,443 | A | 7/1968 | Kawano et al. |
| D216,383 | S | 12/1969 | Fischer |
| D231,809 | S | 6/1974 | Fujishima |
| D255,166 | S | 5/1980 | Ayukawa et al. |

(Continued)

FOREIGN PATENT DOCUMENTS

| | | |
|---|---|---|
| BR | 302018000816-0001 | 7/2018 |
| BR | 302018000818-0001 | 7/2018 |

(Continued)

OTHER PUBLICATIONS www.freakinreviews.cm Finishing Touch Flawless Review, 2 pages, posted on Mar. 8, 2017.

(Continued)

*Primary Examiner* — Omar Flores Sanchez

(74) *Attorney, Agent, or Firm* — Womble Bond Dickinson (US) LLP

(57) ABSTRACT

The present invention provides for a shaving device and more specifically, to a portable, conical shaped shaving apparatus with a central element, top and bottom caps, and when assembled, the apparatus is designed to look like a cosmetic container.

23 Claims, 6 Drawing Sheets

(56) References Cited

U.S. PATENT DOCUMENTS 4,227,301 A 10/1980 Van Hemmen et al.
4,332,321 A 6/1982 Wratschko
D279,930 S 7/1985 George
D283,059 S 3/1986 Satoh et al.
D305,162 S 12/1989 Mockovak
D305,806 S 1/1990 Fujisawa
D307,491 S 4/1990 Okada
4,912,845 A 4/1990 Inoue
5,012,576 A 5/1991 Johannesson
5,135,406 A 8/1992 Ishikawa
D368,984 S 4/1996 Nakashima et al.
D400,303 S 10/1998 Tanaka et al.
D416,355 S 11/1999 Lerolle
D424,746 S 5/2000 Lee
6,272,752 B1 8/2001 Pino
6,502,309 B2 1/2003 De Vries et al.
D473,974 S 4/2003 Fuller
D478,690 S 8/2003 Sgariboldi
D479,017 S 8/2003 Sgariboldi
D485,013 S 1/2004 Leventhal et al.
D488,260 S 4/2004 Khubani
D497,035 S 10/2004 Khubani
D503,495 S 3/2005 Maeda
D513,092 S 12/2005 Ajootian
D514,257 S 1/2006 Bokelman-Dumas
D516,245 S 2/2006 Ohta et al.
7,152,323 B1 12/2006 Lin
D536,135 S 1/2007 Kitagawa
D561,941 S 2/2008 Khubani
7,401,406 B2 7/2008 Morisugi et al.
D585,601 S 1/2009 Althoff et al.
7,497,218 B2 3/2009 Gueret
7,669,605 B2 3/2010 Cho
D617,050 S 6/2010 Lou
D617,051 S 6/2010 Pires et al.
D632,014 S 2/2011 Lee
D634,067 S 3/2011 Stowers et al.
D634,068 S 3/2011 Stowers et al.
D637,759 S 5/2011 Byun
D652,990 S 1/2012 Strickland
D663,483 S 7/2012 Lee
D673,325 S 12/2012 Martines
D674,144 S 1/2013 Yamamoto et al.
D674,145 S 1/2013 Ino
D674,558 S 1/2013 Ino
D675,377 S 1/2013 Boulanger
D675,778 S 2/2013 Vetu
D675,779 S 2/2013 Vetu et al.
8,484,849 B2 7/2013 Morisugi et al.
8,484,850 B2 7/2013 Morisugi et al.
8,563,904 B2 10/2013 Cho
D695,962 S 12/2013 Prat-Pfister et al.
D696,461 S 12/2013 Prat-Pfister et al.
D698,491 S 1/2014 Ellison et al.
D701,346 S 3/2014 Hefetz et al.
D704,066 S 5/2014 De Lima Paschoal et al.
D712,596 S 9/2014 Lee et al.
8,959,775 B2 * 2/2015 Yabuuchi ..... B26B 19/148 30/240
D728,159 S 4/2015 Szymanski
D728,160 S 4/2015 Szymanski
D757,363 S 5/2016 Sugiyama
D758,015 S 5/2016 Prat-Pfister
D758,017 S 5/2016 Smith
D758,663 S 6/2016 Van Maanen
D758,664 S 6/2016 Van Maanen
D776,877 S 1/2017 Zadro
D777,375 S 1/2017 Frankel
D779,124 S 2/2017 Houyoux
D781,496 S 3/2017 Butler et al.
D785,871 S 5/2017 Staab et al.
9,743,738 B2 8/2017 Sanchez-Martinez et al.
D797,377 S 9/2017 Reggiani et al.
9,821,478 B2 * 11/2017 Kleine Doepke ..... B26B 19/143
D812,301 S 3/2018 Tan
D818,646 S 5/2018 Szymanski et al.
D821,204 S 6/2018 Reggiani et al.
D828,628 S 9/2018 Mori et al.
D830,634 S 10/2018 Gamble et al.
D834,253 S 11/2018 Khubani et al.
D834,254 S 11/2018 Khubani et al.
D836,840 S 12/2018 Khubani et al.
D841,246 S 2/2019 Stowers
D841,247 S 2/2019 Stowers
D841,887 S 2/2019 Stowers
10,300,619 B2 5/2019 Khubani et al.
D857,296 S 8/2019 Khubani et al.
D857,297 S 8/2019 Khubani et al.
10,391,649 B1 8/2019 Khubani et al.
D865,291 S 10/2019 Xiong
D868,373 S 11/2019 Kling et al.
10,850,409 B2 * 12/2020 Kleine Doepke ..... B26B 19/143
2005/0028369 A1 2/2005 Cocchiarella et al.
2005/0144783 A1 7/2005 Yiu
2006/0156551 A1 7/2006 Khubani et al.
2010/0095531 A1 4/2010 Akkerman et al.
2011/0072668 A1 3/2011 Morisugi et al.
2011/0232096 A1 * 9/2011 Yabuuchi ..... B26B 19/38 30/29.5
2014/0157957 A1 6/2014 Mimura et al.
2015/0246454 A1 * 9/2015 Mintz ..... B26B 19/44 30/124
2017/0165853 A1 6/2017 Li et al.
2017/0203450 A1 7/2017 Hitson
2017/0266824 A1 9/2017 Veldhuis et al.
2018/0071927 A1 3/2018 Kleine Doepke et al.
2018/0290318 A1 10/2018 Khubani et al.
2018/0326603 A1 11/2018 Moss
2018/0333875 A1 11/2018 Lau
2019/0320778 A1 10/2019 Moon

FOREIGN PATENT DOCUMENTS

CA 179118 5/2019
CA 179119 5/2019
CN D1189187 9/2003
CN D1189459 9/2003
CN 300831331 9/2008
CN 201132325 Y 10/2008
CN 301688539 9/2011
CN 301903889 5/2012
CN 302125081 10/2012
CN 202943656 5/2013
CN 203471807 3/2014
CN 203471808 3/2014
CN 203636849 6/2014
CN 102848408 4/2015
CN 303457621 11/2015
CN 303482791 12/2015
CN 103433945 2/2016
CN 205363974 7/2016
CN 304185953 6/2017
CN 304186004 6/2017
CN 304334779 10/2017
CN 107379032 11/2017
CN 304416637 12/2017
CN 304446416 1/2018
CN 304457107 1/2018
CN 304501107 2/2018
CN 304506970 2/2018
CN 304516516 2/2018
CN 304516519 2/2018
CN 304621293 5/2018
CN 304644627 5/2018
CN 304696505 6/2018
CN 304700973 6/2018
CN 207616632 7/2018
CN 207639841 7/2018
CN 304739096 7/2018
CN 304764441 8/2018
CN 304814295 9/2018
CN 108673574 10/2018
CN 208020233 U 10/2018
CN 304851086 10/2018

(56) References Cited

FOREIGN PATENT DOCUMENTS

| | | |
|---|---|---|
| CN | 304883675 | 11/2018 |
| CN | 304889593 | 11/2018 |
| CN | 304947969 | 12/2018 |
| CN | 304964171 | 12/2018 |
| CN | 304970030 | 12/2018 |
| CN | 305077826 | 3/2019 |
| CN | 109910065 | 6/2019 |
| CN | 305449692 | 11/2019 |
| CN | 305583508 | 1/2020 |
| DE | 402017203423-0003 | 1/2018 |
| EM | 001272488-0003 | 4/2011 |
| EM | 001272488-0004 | 4/2011 |
| EM | 001401533-0001 | 3/2016 |
| EM | 004171247-0001 | 9/2017 |
| EM | 004385656-0001 | 1/2018 |
| EM | 004385656-0002 | 1/2018 |
| EM | 004698421-0001 | 2/2018 |
| EM | 004411981-0007 | 4/2018 |
| EM | 005316213-0001 | 6/2018 |
| EM | 005316213-0002 | 6/2018 |
| EM | 005611712-0001 | 8/2018 |
| EM | 005823119-0001 | 11/2018 |
| EM | 005823119-0002 | 11/2018 |
| EM | 005837267-0001 | 11/2018 |
| EM | 005843216-0001 | 12/2018 |
| EM | 005843216-0002 | 12/2018 |
| EM | 006565495-0001 | 6/2019 |
| EM | 006684940-0001 | 8/2019 |
| GB | 6056436 | 3/2019 |
| IN | 313208-001-0001 | 12/2019 |
| JP | D1437855 | 3/2012 |
| JP | D1504741 | 8/2014 |
| JP | D1504917 | 8/2014 |
| JP | D1611116 | 8/2018 |
| JP | D1611117 | 8/2018 |
| KR | 3020060050934 | 8/2007 |
| KR | 300913973.0000 | 7/2017 |
| KR | 3020170039818 | 8/2017 |
| KR | 300922559.0000 | 9/2017 |
| KR | 3020170041319 | 9/2017 |
| KR | 3020180000186 | 1/2018 |
| KR | 3020180007491 | 2/2018 |
| RU | 00094348 | 7/2015 |
| WO | WO D049067-001 | 6/1999 |
| WO | WO 2014/088496 | 6/2014 |
| WO | WO 2016/187812 | 12/2016 |

OTHER PUBLICATIONS

Finishing Touch Flawless Brows, www.amazon.com, 1 page, (Year: 2018).

Decision of Invalidity of European Registered Community Design 004171247-0001, dated Apr. 12, 2018.

www.amazon.com, Bangbreak-Eyebrow Hair Remover, Customer Review (Daisy Lumahan), "Say 'No' to Ouch and save money going to the salon use this Laser hair removal," Dec. 28, 2018.

www.amazon.com, BESTIDY Women's Brows, Customer Review (Ashley K), "Used product. Do not recommend," Oct. 10, 2018.

www.amazon.com, Finishing Touch Flawless Brows, Customer Review (Pamela), "Even my Eyebrow stylist was Impressed," 1 page, Jul. 22, 2018.

Wayback Machine "Site live" date for Flawless Brows, Mar. 20, 2018, <https://web.archive.org/web/*/getflawlessbrows.com/*>.

www.amazon.com, MINO Ant Eyebrows Remover, Customer Review (Lexi W), "Disappointed," Nov. 17, 2018.

Lady Shaver Lipstick shape, www.imall.com, 1 page, downloaded Aug. 7, 2019.

Naver, Flawless Facial Fluffy Epilator, Feb. 28, 2019, https://search.shopping.naver.com/catalog/20309390234?query=%EC%A0%9C%EB%AA%A8%EA&B8%B0&NaPm=ct%3Dklahme60%7Ccr%Dcc07522a00d5087a54f9cd76f89d0a9ff2583000%7Cu%3Dslsl%7Csn%3D95694%7Chk%3D76b5a6d9d445a8a295dad81c52205aba29ee1216.

Naver, Batum Floris Down Epilator, Feb. 28, 2018, https://search.shopping.naver.com/catalog/13460499855?qury=%EC%A0%9C%EB%AA%A8%EA%B8%B0%NaPm=ct%3Dklah47ng%7Cci%3D928534e60d40eec7669526e193a92bb8fdc1b65a%7Ctr%3Dslsl%7Csn%3D95694%7Chk%3Df2b44ce47b9e71173268495733d86795b15f5012.

Auction., Female Epilator Finishing Touch Flawless Hair Remover, Jan. 31, 2018, http://itempage3.auction.co.kr/DetailView.aspx?ItemNo=B492760711&frm3=V2.

"Finishing Touch Flawless Brows Eyebrow Hair Remover, Blush/Rose Gold," Date of posting: Jan. 14, 2019, https://www.amazon.com/Finishing-Touch-Flawless-Eyebrow-Remover/dp/B07P9CS38P.

* cited by examiner

PORTABLE HAIR REMOVAL APPARATUS

RELATED APPLICATION

This is a utility of the provisional application of U.S. Application Ser. No. 62/712,853 filed on Jul. 31, 2018 and entitled "Portable Shaving Apparatus".

BACKGROUND OF THE INVENTION

Field of the Invention

This invention relates to an article and more specifically, to a portable shaving apparatus designed to look like a cosmetic container such as a lipstick case, make-up case or make-up applicator case.

SUMMARY OF THE INVENTION

In one embodiment, the present invention relates to a portable shaving apparatus comprising: a central component having opposing ends, a first top end comprising a removable attachment and a second bottom end having an exposed cavity, the exposed cavity designed to receive a power source, a first removable, external component designed to attach to a portion of the central component and cover the cavity, and a second removable, external component designed to cover the attachment, and the second external component is designed to attach to a portion of the central component and when in a closed position, and the apparatus is designed to look like a cosmetic container.

In a further embodiment, a shaving apparatus comprising a central component having opposing ends, a first top end comprising a removable attachment having a shaving head that has sides that are conical in shape leading up to a flat top surface, there are elongated slits that continually run from sides to a flat top, the flat top also has circular openings, the elongated slits and circular openings allow the apparatus to shave hair that comes into contact with the side and the flat top surfaces and a second bottom end having an exposed cavity, the exposed cavity designed to receive a power source, a first removable, external component designed to attach to a portion of the central component and cover the cavity, and a second removable, external component designed to cover the attachment, the second external component is designed attach to a portion of the central component and when in a closed position, the apparatus is designed to look like a cosmetic container.

In another embodiment, the apparatus further comprising a motor, and the motor is situated within the first top end of the central component. In yet another embodiment, the apparatus further comprising a power source, and the power source is a battery, including rechargeable batteries.

In still another embodiment, the attachment is selected from a group consisting essentially of a rotary blade, a shaving blade, a trimmer, a brush, a buffer, a pumice, a rotary cleaning device, an exfoliating device, a make-up brush, a make-up remover and combinations thereof. In still yet another embodiment, the apparatus is from about one inch to about four inches long or tall.

In a further embodiment, the cosmetic container is selected from a group consisting essentially of a lipstick case, an applicator case, a makeup case and combinations thereof. In a further embodiment, the external component of the apparatus has a cross section, and the cross section has a shape selected from a group consisting essentially of oval, ellipse, eye-shaped, oblong and combinations thereof.

In still a further embodiment, the apparatus further comprising at least one light. In yet a further embodiment, the light is designed to illuminate target area of a user's body. In still yet a further embodiment, the light is a flashlight situated on at least one of the external components. In another further embodiment, the apparatus further comprising an on/off switch situated on the central component.

In another further embodiment, the second external component comprises a closed top end and an opened bottom end, and the bottom end of the second external component having at least one protrusion, and the protrusion designed to align with the on/off switch and shut off the apparatus in the closed position.

In another further embodiment, the second external component comprises a closed top end and an opened bottom end, and the bottom end of the second external component having at least one protrusion, the protrusion designed to align with the on/off switch and shut off the apparatus in the closed position. In still another embodiment, the second external component is self-aligning with the first external component.

In yet another embodiment, the central component comprises a storage compartment. In still yet another embodiment, at least one of the external components comprises a storage compartment. In a further embodiment, the apparatus further comprising a shaft coupled to the motor, the shaft is an elongated polygon configured to interface with the attachment. In another further embodiment, the apparatus further comprising a mirror.

In a further embodiment, the present invention provides for a portable shaving apparatus comprising: a central element having opposing ends, a first top end comprising a removable attachment and a second bottom end having an internal cavity, the internal cavity designed to receive a power source, a first removable bottom cap designed to attach to a portion of the central element and cover at least a portion of the bottom end of the central element, and a second removable top cap designed to cover the attachment, the second cap is designed attach to a portion of the central element and when in a closed position, and the apparatus is designed to look like a cosmetic container.

In a further embodiment, the apparatus further comprises a motor, a shaft, a power source and at least one storage compartment. In another embodiment, an apparatus having at least one blade that is designed to cut hair that enters the shaving head from the sides and/or the flat top. In yet another embodiment, an apparatus having at least two blades that are designed to cut hair that enters the shaving head from the sides and/or the flat top.

In still another embodiment, an apparatus having a shaving head having a light to illuminate an area where the apparatus is being used. In still yet another embodiment, an apparatus having a shaving head that illuminates an area where the apparatus is being used with three hundred sixty degrees of light.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description serves to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention is disclosed herein, however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
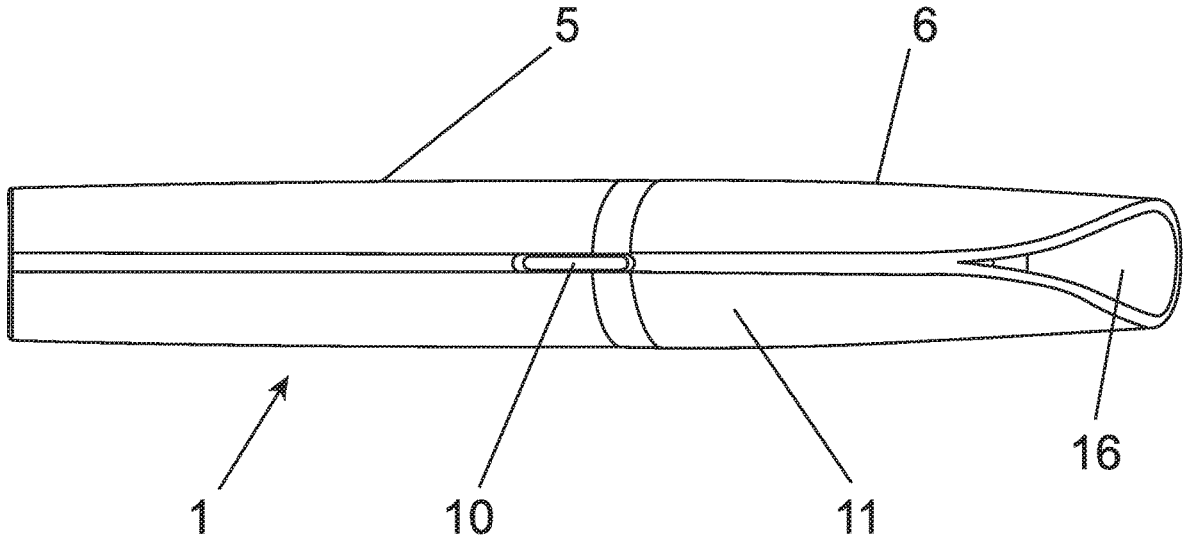
FIG. 1 is a front view of one of the embodiments of the present invention.

FIG. 1 illustrates the shaving apparatus 1 having a first removable external structure 5, a second external removable structure 6, an on/off switch 10, a protrusion 11 on the second removable external component 6, and a mirror 16. The protrusion 11 helps prevent the shaving apparatus from moving and/or rolling off of flat surfaces. The mirror 16 is located on the top of the second external component 6. The mirror 16 can be located on alternative areas of the shaving apparatus. The power switch 10 has an on and off position, it is designed in such away that if it is in the on position and the second external component 6 is placed onto the shaing apparatus 1 the power switch 10 is moved to the position.

Figure 2:
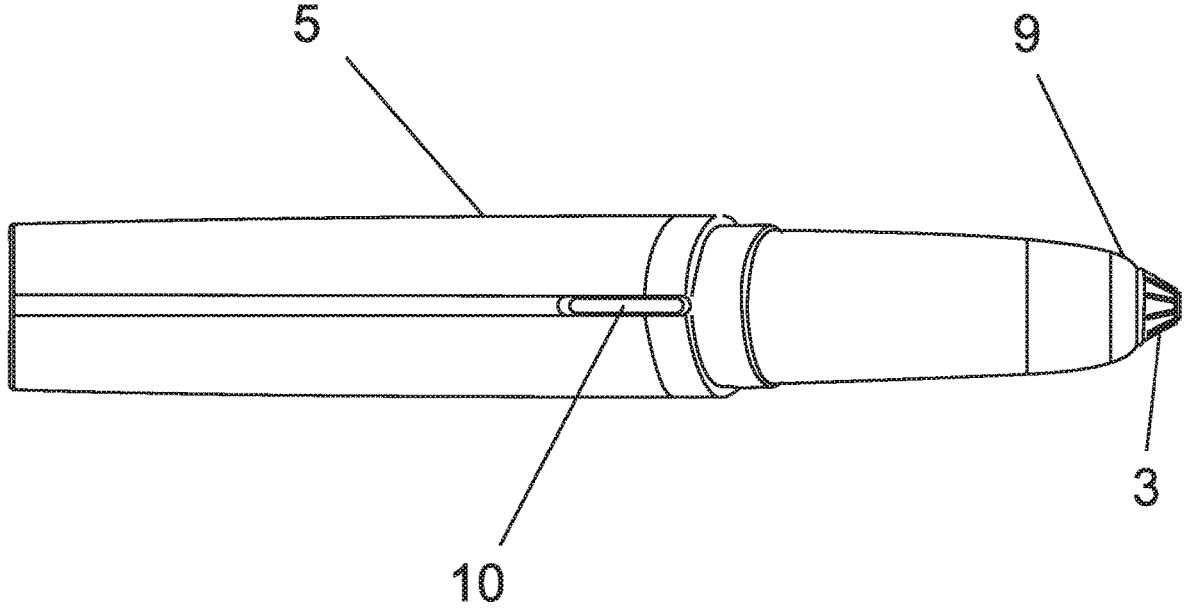
FIG. 2 is a front view of FIG. 1 showing second removable external component removed of one of the embodiments of the present invention.

FIG. 2 illustrates the shaving apparatus 1 having a removable attachment 3, a first removable external structure 5, a light 9, an on/off switch 10. FIG. 2 further shows that the light 9 is located just below the conical tip of removable attachment. The light 9 provides 360 degrees of light around the conical tip providing for optimal lighting of a surface being shaved.

Figure 3:
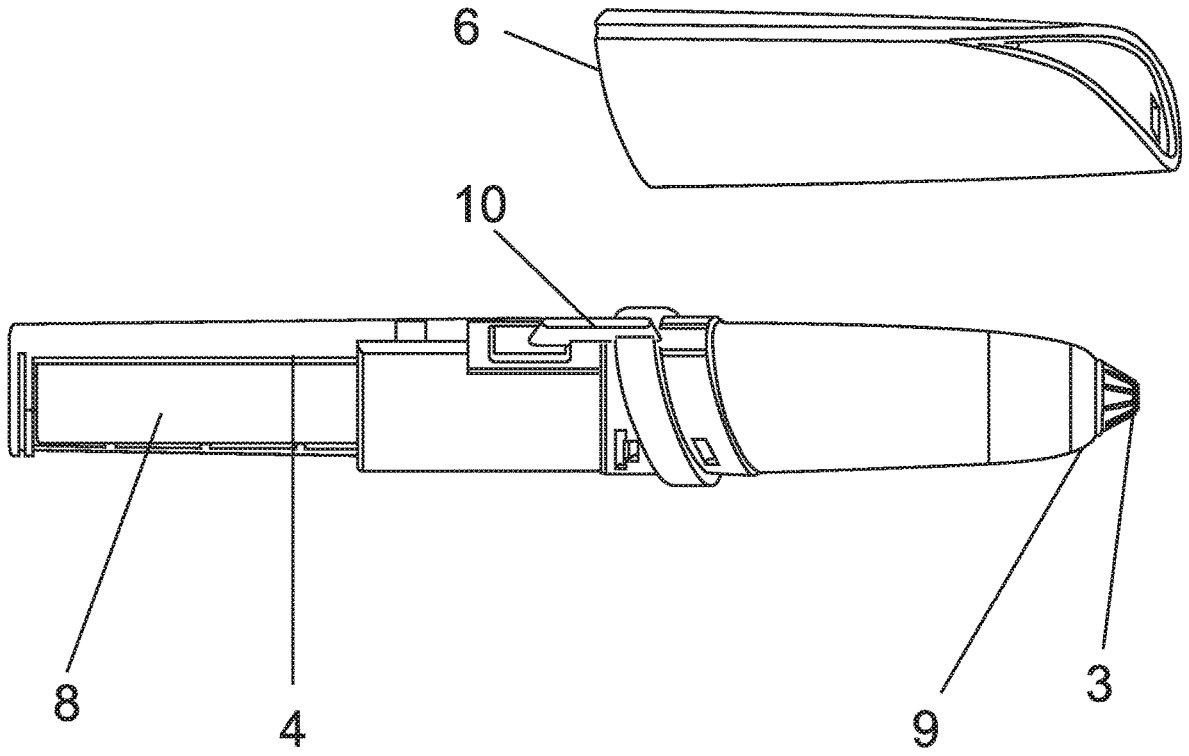
FIG. 3 is a perspective view of the central component of one of the embodiments of the present invention.

FIG. 3 illustrates the central component 2 of the shaving apparatus 1, having a removable attachment 3, a cavity 4, a second removable external structure 6, a power source 8 and an on/off switch 10. FIG. 3 further shows the cavity 4 exposed by having the first external structure 5 removed from the shaving apparatus 1. The first external structure 5 and the second external may be removable from the shaving apparatus 1. The first external structure 5 can be permanently connected to said shaving apparatus 1 thereby containing the contents of cavity 4.

Figure 4:
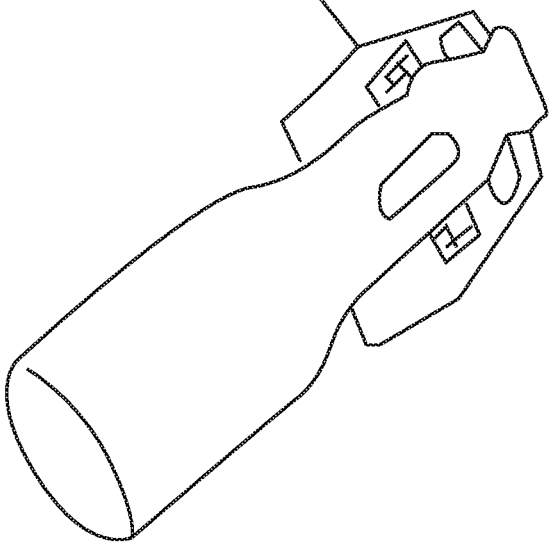
FIG. 4 is a side view of one of the embodiments of the present invention.

FIG. 4 shows the blade 17 of the shaving head 3. The blade 17 is capable of cutting from the sides and from the top of the shaving head.

Figure 5:
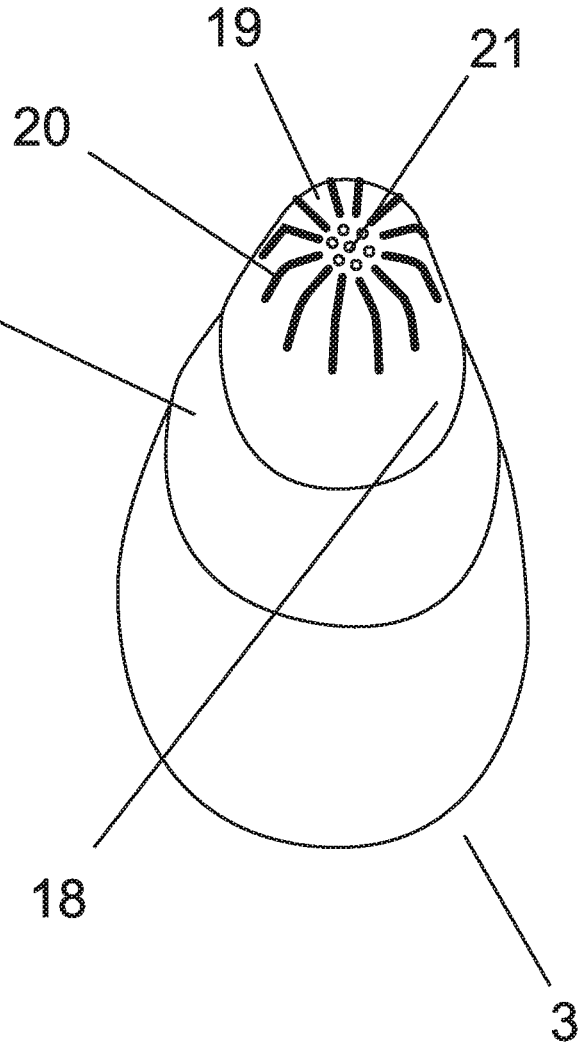
FIG. 5 is a top view of one of the embodiments of the present invention, and FIG. 6

FIG. 5 shows the attachment (shaving head) 3 having a light 9, conical sides 18 a flat top 19, elongated slits 20 that run from at least a portion of the conical sides 18 to the at least a portion of the flat top 19, and circular openings 21 on the flat surface. The blade 17 is designed so that is can cut hairs that enter either the sides or top of the shaving head 3.

FIG. 4 and FIG. 5 show that the blade 17 has a shape that mirror or compliment the conical side 18 and flat top 19 of the shaving head 3. The complimentary shape of the blade 17 to the shaving head 3 is what allows for hair to be cut when they enter from the circular opening 21 on the top flat surface of the shaving head 3 and the elongated slits 21 from the sides.

Figure 6:
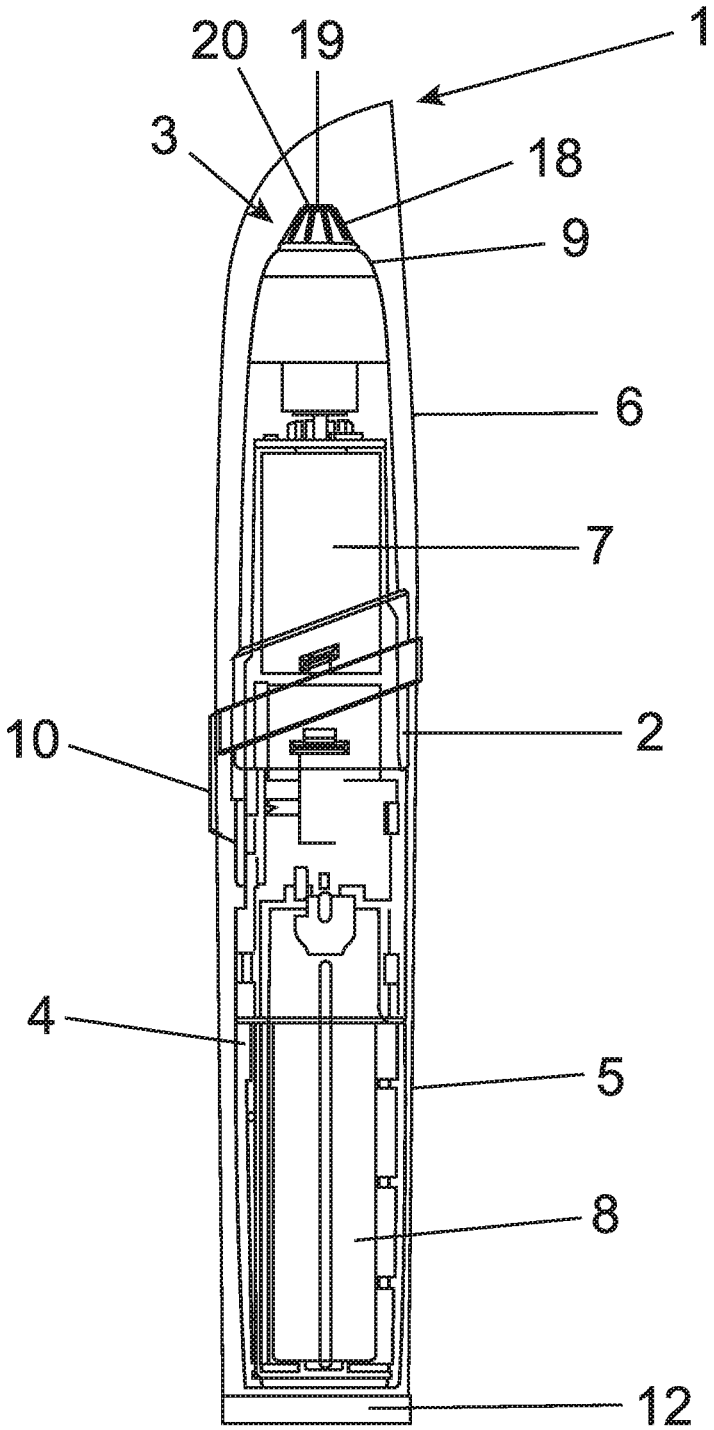
Figure 7:
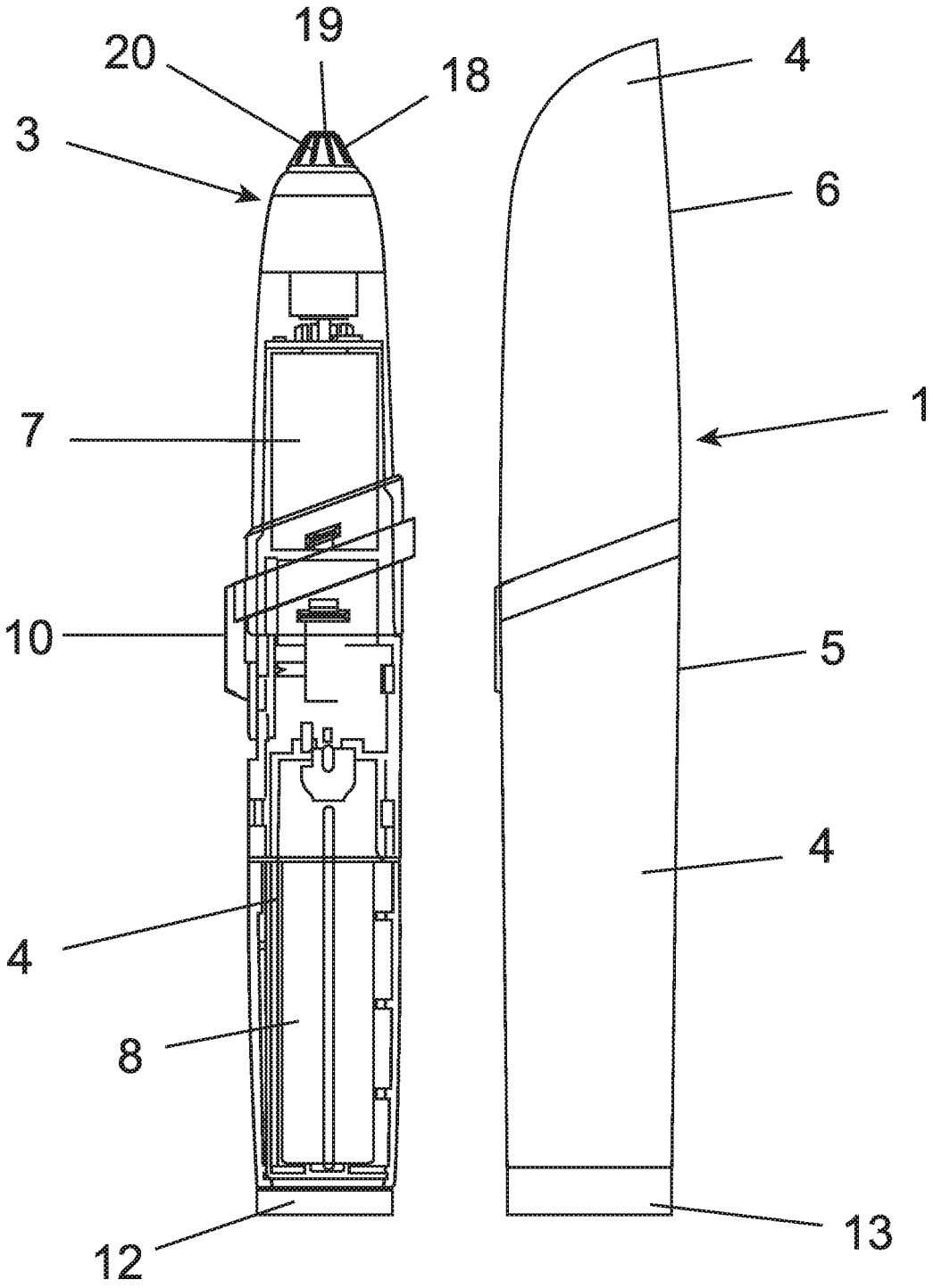
FIG. 7 is a side view of the internal structure of one of the embodiments of the present invention.

FIG. 6 and FIG. 7 illustrate the shaving apparatus 1 having a central component 2, a removable attachment 3, a cavity 4 of the central component 2, a first removable external structure 5, a second external removable structure 6, a motor 7, a power source 8, an on/off switch 10, a storage compartment 12 of the central component 2, a storage compartment 13 of first removable external structure 5, and a storage compartment 14 of second removable external structure 6. The cavity of the central component 2 receives a power source 7. The second removable structure 6 houses the motor 7. The on/off switch 10 is located on the exterior surface of the first removable structure 5.

The power source 8 sends power to the motor 7 which creates rotary power. The rotary power of the motor causes the removable attachment 3 (having head 3) to rotate in operation allowing for a cutting action. The on/off switch 10 allows to power source 8 to deliver power to the motor 7 to make the shaving apparatus 1 in an operating mode and to stop power from being sent to the motor 8 in an off mode.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A portable hair removal apparatus comprising:

a central component having opposing ends, a first top end comprising a removable attachment, said attachment having a shaving head that has sides that are conical in shape leading up to a flat top surface, said shaving head comprises elongated slits that continually run from said sides to said flat top, said flat top comprises circular openings, said elongated slits and said circular openings allow said apparatus to shave hair that comes into contact with said side and said flat top surfaces, a second bottom end of said central component having an exposed cavity, said exposed cavity is designed to receive a power source:

a first external component designed to attach to a portion of said central component and cover said cavity, a second external component is designed to cover said attachment and to attach to a portion of said central component;

wherein the first top end of the central component includes a light that is configured to illuminate an area where said apparatus is being used, the light being arranged to provide 360 degrees of light around the first top end of the central component.

2. The apparatus of claim 1 further comprising a motor, said motor is situated within said cavity of said central component.

3. The apparatus of claim 1 further comprising a power source, said power source is a battery.

4. The apparatus of claim 1 wherein said attachment is selected from a group consisting essentially of a rotary blade, a shaving blade, a trimmer, a brush, a buffer, a pumice, a rotary cleaning device, an exfoliating device, a make-up brush, a make-up remover and combinations thereof.

5. The apparatus of claim 1 wherein said apparatus is from about one inch to about seven inches in length.

6. The apparatus of claim 1 further comprising an on/off switch situated on said central component.

7. The apparatus of claim 1 wherein said second external component is self-aligning with said first external component.

8. The apparatus of claim 1 wherein said central component comprises a storage compartment.

9. The apparatus of claim 1 wherein at least one of said external components comprises a storage compartment.

10. The apparatus of claim 2 further comprising a shaft coupled to said motor, said shaft is an elongated polygon configured to interface with said attachment.

11. The apparatus of claim 1 further comprising a mirror.

12. The apparatus of claim 1 having at least one blade that is designed to cut hair that enters said shaving head from said sides and said flat top.

13. The apparatus of claim 1 having at least two blades that are designed to cut hair that enters said shaving head from said sides and said flat top.

14. The apparatus of claim 1 wherein said first and said second external components are removable from said shaving apparatus.

15. The apparatus of claim 1 wherein said first external component is permanently attached to said shaving apparatus.

16. A portable shaving apparatus comprising:

a central element having opposing ends, a first top end comprising a removable shaving head and a second bottom end having an internal cavity, said internal cavity designed to receive a power source;

a first bottom cap designed to attach to a portion of said central element and cover at least a portion of said bottom end of said central element;

a second top cap designed to cover said shaving head when attached to a portion of said central element, wherein the first top end of the central element includes a light that is configured to illuminate an area where said apparatus is being used, the light being arranged to provide 360 degrees of light around the first top end of the central element.

17. The apparatus of claim 16 wherein said shaving head has sides that are conical in shape leading up to a flat top surface, said shaving head comprises elongated slits that continually run from said sides to said flat top, said flat top comprises circular openings, said elongated slits and said circular openings allow said apparatus to shave hair that comes into contact with said side and said flat top surfaces.

18. The apparatus of claim 16 further comprising a motor, a shaft, a power source and a storage compartment.

19. A hair removal apparatus comprising:

a central element comprising opposing ends, one end having removable shaving head that has sides that are conical in shape leading up to a flat top surface, said shaving head comprises elongated slits that continually run from said sides to said flat top, said flat top comprises circular openings, said elongated slits and said circular openings allow said apparatus to shave hair that comes into contact with said side and said flat top surfaces;

a first bottom cap designed to attach to a portion of said central element and cover a second end of said central element;

a second top cap designed to attached to a portion of said central element to thereby cover said shaving head;

wherein the one end of the central element having the removable shaving head includes a light that is configured to illuminate an area where said apparatus is being used, the light being arranged to provide 360 degrees of light around the one end of the central element having the removable shaving head.

20. The shaving apparatus of claim 19 wherein said first bottom cap is removable.

21. The shaving apparatus of claim 19 where is first bottom cap is permanently attached.

22. The shaving apparatus of claim 19 wherein said second top cap is removable.

23. The apparatus of claim 6 wherein said second external component comprises a closed top end and an opened bottom end, said bottom end of said second external component having at least one protrusion, said protrusion designed to align with said on/off switch and shut off said apparatus in said closed position.

* * * * *